US005826719A

United States Patent [19]

Chen

[11] Patent Number: 5,826,719

[45] Date of Patent: Oct. 27, 1998

[54] TOOL BOX HAVING A DRAWER

[76] Inventor: Kuen Jen Chen, No. 6, Lane 609, Sec. 1, Chong San Road, Da Chia Town, Taichung Hsien, Taiwan

[21] Appl. No.: 868,825

[22] Filed: Jun. 9, 1997

[51] Int. Cl.[6] ..... B65D 85/28

[52] U.S. Cl. ..... 206/373; 206/372; 206/561; 312/902

[58] Field of Search ..... 206/234, 372, 206/373, 1.7, 387.12, 561; 312/902

[56] References Cited

U.S. PATENT DOCUMENTS

| | | | |
|---|---|---|---|
| 3,899,229 | 8/1975 | Ackeret | 206/387.12 |
| 4,303,158 | 12/1981 | Perkins | 206/372 |
| 4,550,828 | 11/1985 | Baldwin et al. | 206/373 |
| 4,577,773 | 3/1986 | Bitel | 206/561 |
| 4,768,651 | 9/1988 | Lanius | 206/373 |
| 4,911,296 | 3/1990 | Hart, Jr. | 206/373 |
| 5,114,007 | 5/1992 | Chen | 206/373 |
| 5,544,744 | 8/1996 | Oman | 206/372 |

*Primary Examiner*—David T. Fidei

[57] ABSTRACT

A tool box includes a base having an opening and an upper space communicating with each other. A cover is pivotally coupled to the base for forming the tool box. An insert is engaged in the upper space of the base, and a drawer is slidably engaged in the opening of the base for allowing the drawer to be pulled outward of the base. The base has a guide channel for guiding the drawer relative to the base and for positioning the drawer to the base. A number of beams and bars are secured in the drawer for forming a number of spaces and for receiving smaller elements.

3 Claims, 3 Drawing Sheets

TOOL BOX HAVING A DRAWER

BACKGROUND OF THE INVENTION

1. Field of the Invention

The present invention relates to a tool box, and more particularly to a tool box having a drawer.

2. Description of the Prior Art

Typical tool boxes comprise a body made by blow-molded process and having a number of cavities for engaging with tools or tool bits. However, the tool boxes have no spaces for engaging with smaller members, such as screws, bolts, gaskets, washers, tapes, etc.

The present invention has arisen to mitigate and/or obviate the afore-described disadvantages of the conventional tool boxes.

SUMMARY OF THE INVENTION

The primary objective of the present invention is to provide a tool box having a slidable drawer for receiving smaller elements.

In accordance with one aspect of the invention, there is provided a tool box comprising a base including an opening and an upper space communicating with each other, a cover pivotally coupled to the base for forming the tool box, an insert engaged in the upper space of the base, and a drawer slidably engaged in the opening of the base for allowing the drawer to be pulled outward of the base.

The base includes at least one channel, the drawer includes at least one protrusion slidably engaged in the channel for guiding a movement of the drawer relative to the base. The base includes at least one bulge extended inward of the channel for forming a depression and for engaging with the protrusion of the drawer and for positioning the drawer to the base.

The drawer includes a bottom portion having a number of grooves formed in the bottom portion, and includes an inner peripheral portion having a number of first slots, the drawer includes a number of beams each having a bottom portion engaged in the grooves and each having at least one second slot, and includes a number of bars each having end portions engaged in the first slots and the second slots for forming a number of spaces. The bars each includes two ends, the ends of the bars each includes a dovetail for engaging with the first slot and the second slot and for allowing the bars to be secured to the base and the beams.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
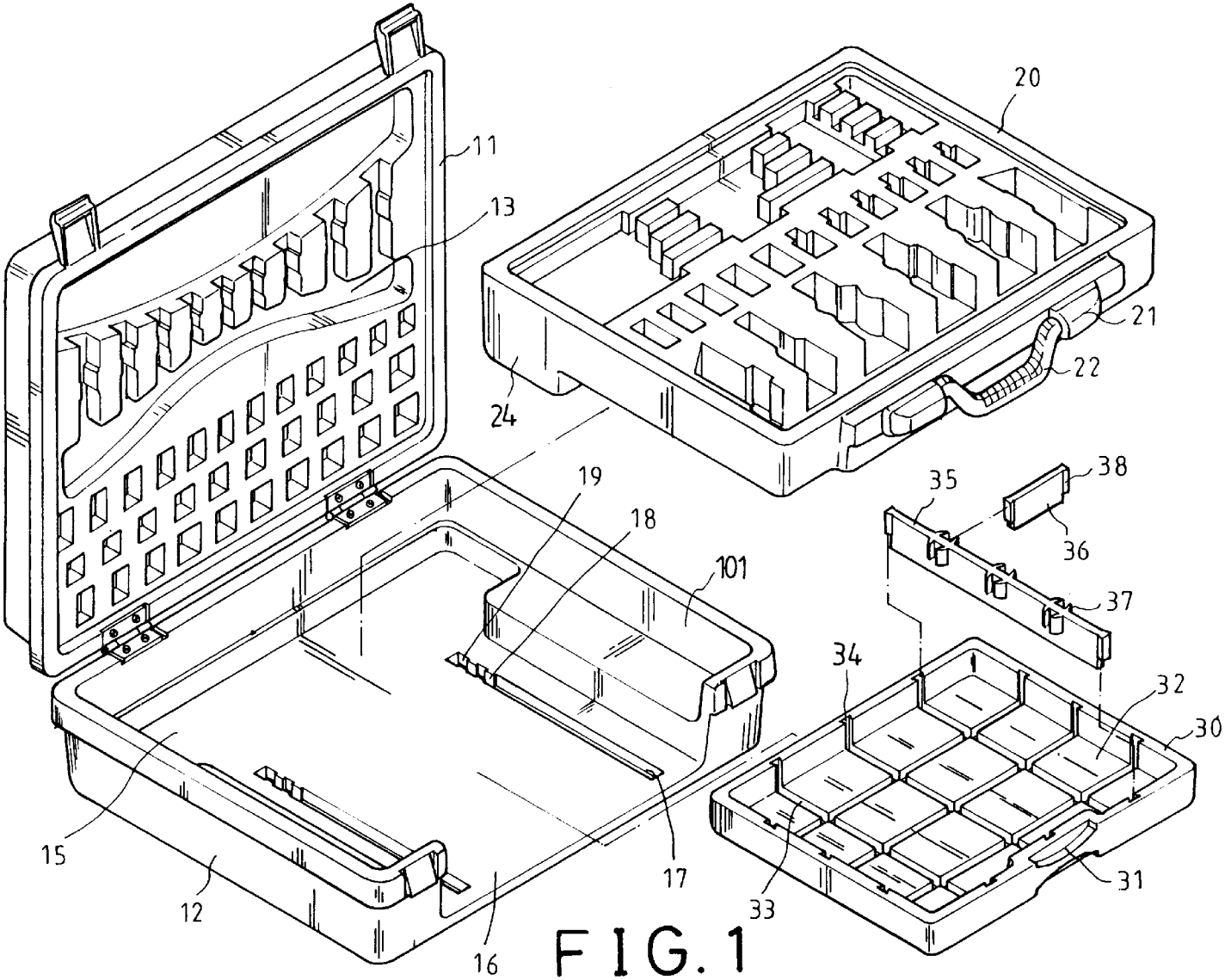
FIG. 1 is an exploded view of a tool box.
Figure 2:
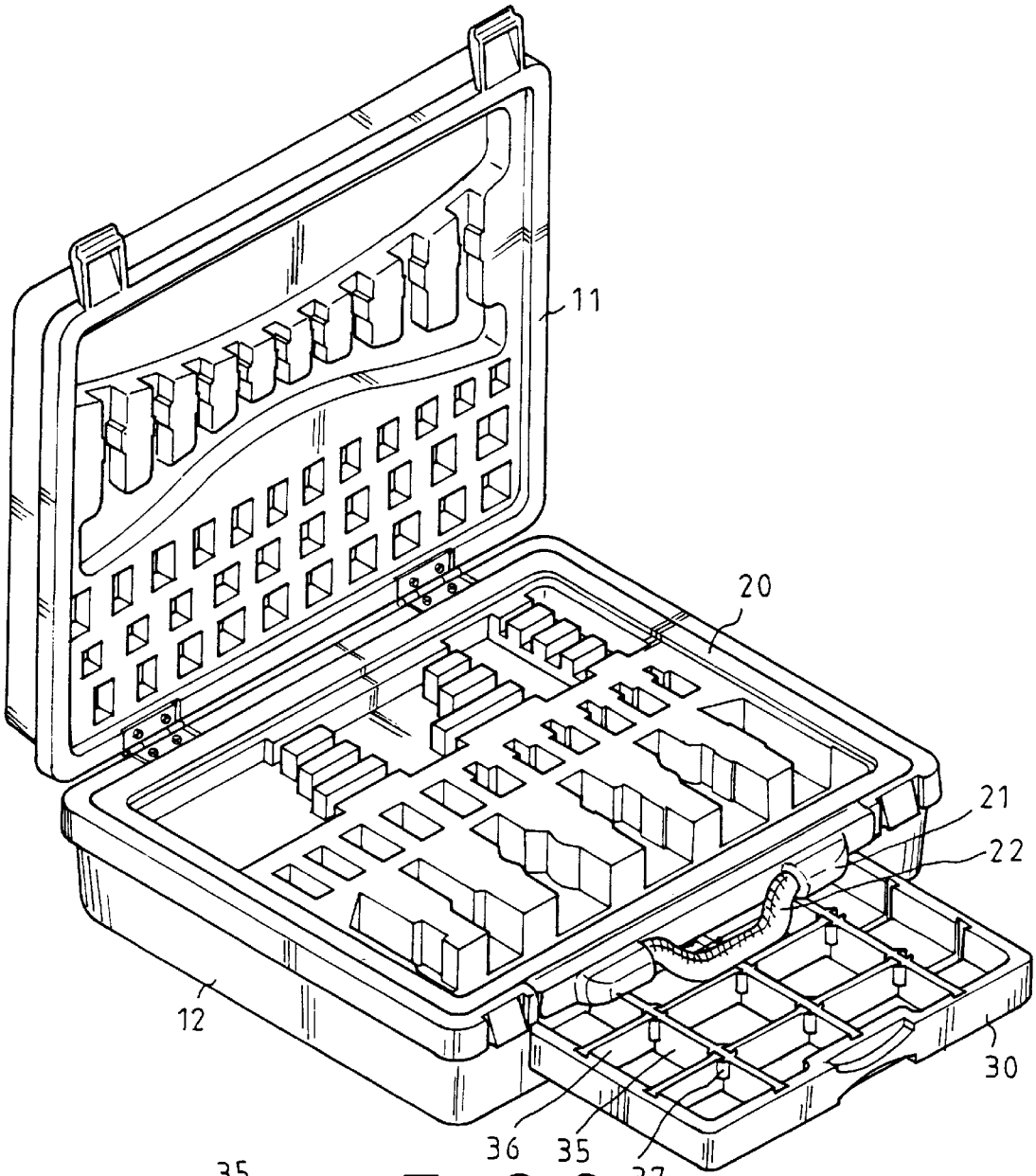
FIGS. 2 and 3 are perspective views illustrating the operation of the tool box.
Figure 3:
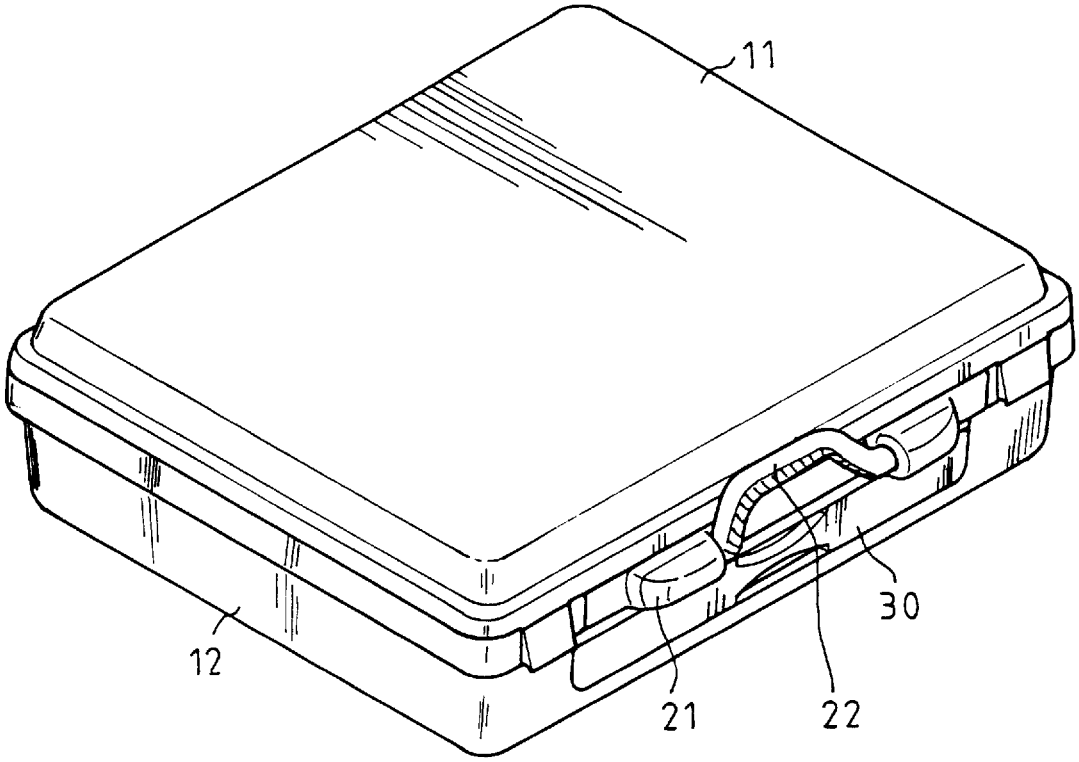

Referring to FIGS. 1–3, a tool box comprises a base 12 and a cover 11 pivotally coupled to the base 12. The cover

11 includes a number of caves 13 for engaging with and for retaining tool bits and/or tools. The base 12 includes a chamber 15 and an opening 16 preferably communicating with each other, and includes a pair of channels 17 formed in the bottom. The base 12 includes one or more bulges 18 extended inward of the channels 17 for forming one or more depressions 19. An insert 20 may be engaged in the upper space 101 of the base 12 and includes two lugs 21 for engaging with a handgrip 22. the upper space 101 is communicating with the opening 16. The insert 20 includes a projection 24 for engaging with the chamber 15 and for retaining the insert 20 in place.

Figure 5:
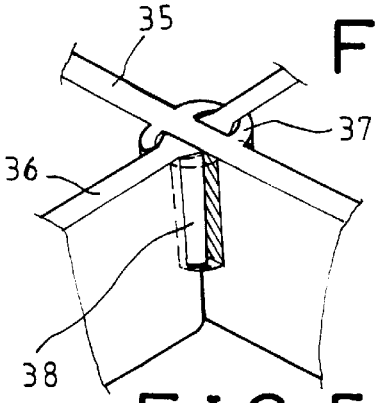
FIG. 5 is a partial perspective view illustrating the partitions of the drawer.
Figure 4:
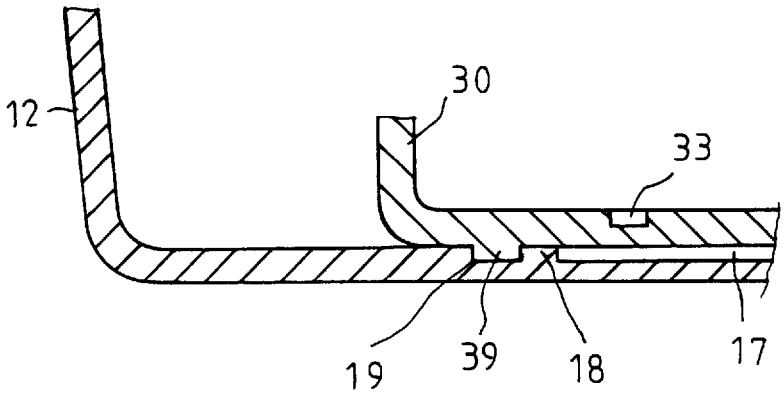
FIG. 4 is a partial cross sectional view showing the engagement of the drawer with the tool box.

A drawer 30 is slidably engaged in the opening 16 and includes one or more recesses 31 for allowing the drawer 30 to he easily pulled outward of the base 12. The drawer 30 includes an interior 32 for receiving various kinds of elements, such as screws, bolts, gaskets, washers, tapes, etc., and includes a number of grooves 33 formed in the bottom and a number of slots 34 formed in the inner peripheral surface. The drawer 30 includes at least one protrusion 39 slidably engaged in the channel 17 for guiding the movement of the drawer 30 relative to the base 12. The protrusion 39 may be engaged with the depression 19 for positioning the drawer 30 relative to the base 12 (FIG. 4). A number of beams 35 have a lower portion engaged in the grooves 33 and each has a number of engaging slots 37. A number of bars 36 each has two dovetails 38 formed in the end portions for engaging with the slots 34 and 37 of the base 12 and of the beams 35. The beams 35 and the bars 36 may form a number of spaces for receiving smaller elements. It is preferable that the slots 34, 37 and the dovetails 38 are slightly tapered (FIG. 5) for allowing the dovetails 38 to be force-fitted in the slots 34, 37.

Accordingly, the tool box in accordance with the present invention includes a drawer slidably engaged in the base for receiving smaller elements and for allowing the smaller elements to be easily found.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a base including an opening and an upper space communicating with each other, said base including at least one channel, a cover pivotally coupled to said base for forming said tool box, an insert engaged in said upper space of said base, and a drawer slidably engaged in said opening of said base for allowing said drawer to be pulled outward of said base, said drawer including at least one protrusion slidably engaged in said at least one channel of said base for guiding a movement of said drawer relative to said base, said base including at least one bulge extended inward of said channel for forming a depression and for engaging with said protrusion of said drawer and for positioning said drawer to said base.

2. A tool box comprising:

a base including an opening and an upper space communicating with each other, a cover pivotally coupled to said base for forming said tool box, an insert engaged in said upper space of said base, and a drawer slidably engaged in said opening of said base for allowing said drawer to be pulled outward of said base, said drawer including a bottom portion having a plurality of grooves formed in said bottom portion, and including an inner peripheral portion having a plurality of first slots, said drawer including a plurality of beams each having a bottom portion engaged in said grooves and each having at least one second slot, and including a plurality of bars each having end portions engaged in said first slots and said second slots for forming a plurality of spaces.

3. A tool box according to claim 2, wherein said bars each includes two ends, said ends of said bars each includes a dovetail for engaging with said first slot and said second slot and for allowing said bars to be secured to said base arid said beams.

* * * * *